United States Patent [19]

Yamazaki et al.

[11] Patent Number: 4,479,280

[45] Date of Patent: Oct. 30, 1984

[54] MAT BASE PLATE

[75] Inventors: Ken Yamazaki, Kobe; Yosuke Yamamoto, Toyonaka; Takehisa Kinoyama, Muko; Kinichi Sasagawa, Takatsuki, all of Japan

[73] Assignee: Duskin Franchise Kabushiki Kaisha, Osaka, Japan

[21] Appl. No.: 211,950

[22] Filed: Dec. 1, 1980

[30] Foreign Application Priority Data

| | | | |
|---|---|---|---|
| Dec. 24, 1979 | [JP] | Japan | 54-178956 |
| Dec. 24, 1979 | [JP] | Japan | 54-178957 |
| Dec. 24, 1979 | [JP] | Japan | 54-178958 |
| Dec. 24, 1979 | [JP] | Japan | 54-178959 |

[51] Int. Cl.[3] ..... A47L 23/22; B32B 3/02

[52] U.S. Cl. ..... 15/217; 428/78; 428/81; 428/157; 428/192

[58] Field of Search ..... 428/45, 78, 81, 157, 428/161, 192, 47, 156; 15/238, 215–217

[56] References Cited

U.S. PATENT DOCUMENTS

| | | | |
|---|---|---|---|
| 3,711,360 | 1/1973 | Kent | 428/81 |
| 4,143,194 | 3/1979 | Wihksne | 428/192 X |

FOREIGN PATENT DOCUMENTS

| | | | |
|---|---|---|---|
| 39643 | 6/1909 | Austria | 428/81 |

*Primary Examiner*—Alexander S. Thomas

*Attorney, Agent, or Firm*—Cushman, Darby & Cushman

[57] ABSTRACT

A mat base plate for use with a shrinkable mat is shown including an upstanding rim extending around a floor of the mat base plate. The rim has a plateau surface at the top thereof, an outer wall and a slope extending from said plateau, continuously to the bottom of the mat-receiving basin that is constituted by the rim and floor of the mat base plate. In the fourth embodiment, the rim is semi-cylindrical or at least convexly arcuate in cross-sectional shape, and has a rough surface having the appearance of a plurality of wave-like convexes and concaves.

2 Claims, 20 Drawing Figures

MAT BASE PLATE

BACKGROUND OF THE INVENTION

1. Field of the Invention

This invention relates to a mat base plate for a door mat which provides an aesthetic appearance even after cleaning and washing resulting shrinkage of the mat.

2. Description of the Prior Art

A mat is indispensable to be placed in front of an entrance of a house so as to remove dust from shoes so that the dust will not be tracked into the house. A carpet having upright fibers is usually used as the mat and it is placed on a mat base plate made of synthetic rubber, synthetic resin and the like. The mat is detachably secured on the mat base plate by means of conventional fasteners such as Velcro hook-and-fleece fasteners.

In the course of time, after the mat which has been cleaned and washed it shrinks so that it is smaller than its original size. At this point a conventional mat presents an inaesthetic appearance. For example, the shrinkage of the mat is easily noticeable at a glance due to the gap created between the mat and the mat base plate which is not shrinkable, since said conventional mat base plate has a border which includes a set of steps disposed around the periphery of the mat.

FIG. 1 is a partial enlarged cross-section showing the appearance of a conventional mat base plate with a shrunken mat placed on it. The floor of the conventional mat base plate 1 is surrounded by an upwardly protruding rim 1*a*. The mat 2 has upright fibers 2*a* thereon. At the stage depicted, the mat 2 has shrunken due to cleaning and a gap 3 has formed between the inner perimeter of the rim 1*a* and the outer perimeter of the mat 2. In such a condition, the viewer notices that the mat has a thickness including said upright fibers 2*a* and recognizes a deep crevice 3 between the inner perimeter of the rim 1*a* and the outer perimeter of the mat 2. A bottom line 4 of the crevice 3, formed by the intersection of the inner wall of the rim 1*a* and upper face of said mat base plate 1 is noticeable as a distinct straight line and it further strengthens an impression that the crevice 3 is a deep one.

A phantom straight line l is shown drawn on FIG. 1 between the upper, inner corner of the rim 1*a* and the outer, lower corner of the mat 2.

SUMMARY OF THE INVENTION

The present invention is premised in part on the fact that if the mat base plate were augmented to fill the region of triangular section which lies below the phantom line l, the cross-sectional area of said gap 3 would be reduced to half or less and consequently said gap 3 cannot be felt so much and the bottom corner line 4 of the crevice is no longer apparent. Thus, the existence of the gap created by the shrinkage of the mat would not be so noticeable.

One of the objects of this invention is to provide a mat base plate having a slant toward the central floor thereof from the upper, inner extent of the perimetrical rim or ridge.

Another object of this invention is to provide a mat base plate having a rough surface provided with a plurality of concaves and convexes on the perimetrical rim or ridge.

BRIEF DESCRIPTION OF THE ACCOMPANYING DRAWINGS

FIG. 1 is a partial enlarged cross-section showing a conventional mat base plate on which a shrunken mat is placed, FIG. 2 is a top plan view of a mat base plate showing the first embodiment of this invention, FIG. 3 is an enlarged fragmentary perspective view of the mat base plate of FIG. 2, FIG. 4 is an enlarged fragmentary cross-sectional view taken along line A—A of FIG. 2, FIGS. 5 and 6 are enlarged fragmentary cross-sectional views showing the use of a progressively shrinking mat on the mat base plate of FIGS. 2–4.

FIG. 7 is a top plan view showing the second embodiment of the mat base plate of this invention, FIG. 8 is a cross-sectional view taken along line B—B of FIG. 7, FIGS. 9 and 10 are enlarged fragmentary cross-sectional views showing the use of a progressively shrinking mat on the mat base plate of FIGS. 7 and 8, FIGS. 11 and 12 are enlarged fragmentary cross-sectional views showing modifications to the mat base plate of the second embodiment, FIG. 13 is a top plan view showing the third embodiment of the mat base plate of this invention, FIG. 14 is an enlarged fragmentary cross-sectional view taken along line C—C of FIG. 13, FIGS. 15 and 16 are enlarged fragmentary cross-sectional views showing the use of a progressively shrinking mat on the mat base plate of FIGS. 13 and 14, FIG. 17 is a top plan view showing the fourth embodiment of the mat base plate of this invention, FIG. 18 is an enlarged fragmentary cross-sectional view taken along line D—D of FIG. 17, and FIGS. 19 and 20 are enlarged fragmentary cross-sectional views showing the use of a progressively shrinking mat on the mat base plate of FIGS. 17 and 18.

DESCRIPTION OF THE PREFERRED EMBODIMENTS

Figure 1:
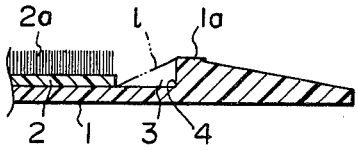
FIG. 1 PRIOR ART
Figure 2:
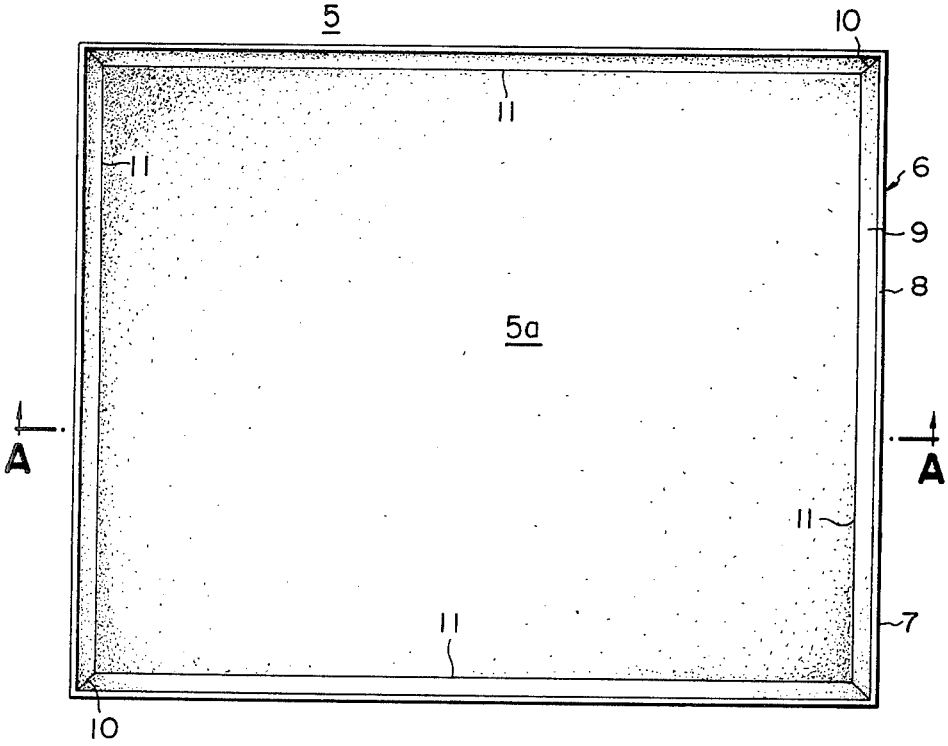
Figure 4:
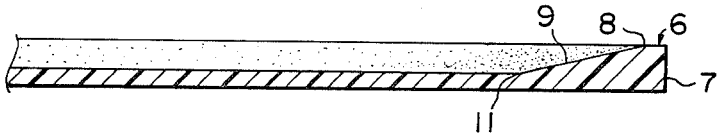
Figure 3:
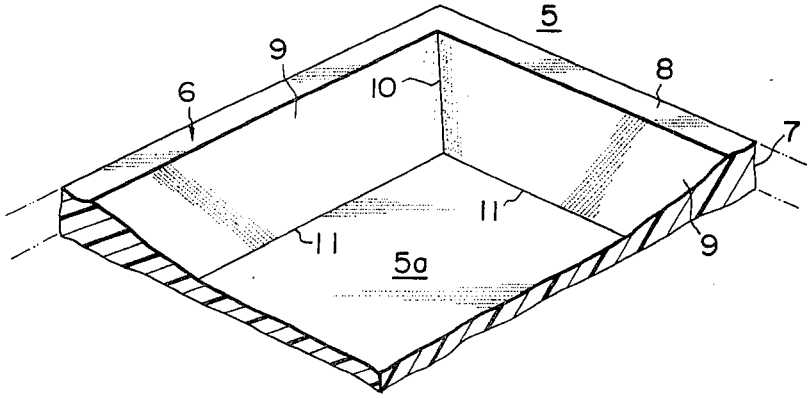

Now, the preferred embodiments according to this invention will be discussed hereinafter by reference to the accompanying drawings. A mat base plate generally designated by the numeral 5 is formed of synthetic resin, synthetic rubber and the like, so as to include a central flat plate or floor with an upwardly projecting rim 6 provided on the periphery of the floor. This rim 6 has an upright wall 7 at its outer perimeter and its upper end is a planar surface 8 of a certain width, i.e. a plateau. The inner portion of the rim 6, from the plateau toward the center of the floor is configured so as to have a relatively gradual slope 9 which is continuous to the perimeter of the floor, thus creating with the floor a concave basin 5*a* on which a mat 12 may be placed. The slope 9 extends about the entire periphery of the square mat 12 (FIGS. 5 and 6) and consequently this slope creates intersection lines 10 which run diagonally at the corners of the mat base and the basin 5*a* creates horizontal lines 11 at the intersections with said slope 9. Hence, the shape formed by the horizontal lines 11 is rectangular and its size is smaller than that of the mat under its most shrunken state after several cleanings, e.g. as is shown in FIG. 6.

Figure 5:
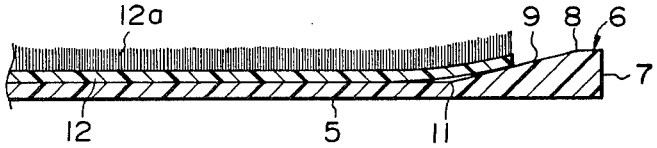

When, prior to any shrinkage, the mat 12 is placed on the mat base plate 5 formed as described above, the outer marginal portion of the mat 12 rides on the slope 9 as shown in FIG. 5, so that its outer perimeter lies at an intermediate location on the slope 9. Even when the mat fibers 12*a* extend upwards to a level that is slightly higher than the level of the plateau 8 of the rim 6, there is no risk that a person will trip over the edge of the mat nor that the mat will be torn off from said mat base plate 5 because the mat fibers 12*a* are remarkably resilient.

Figure 6:
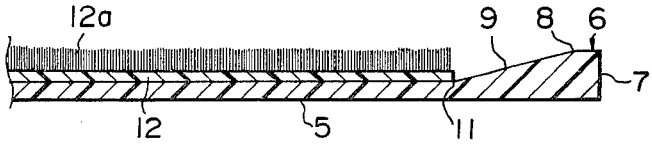
Figure 7:
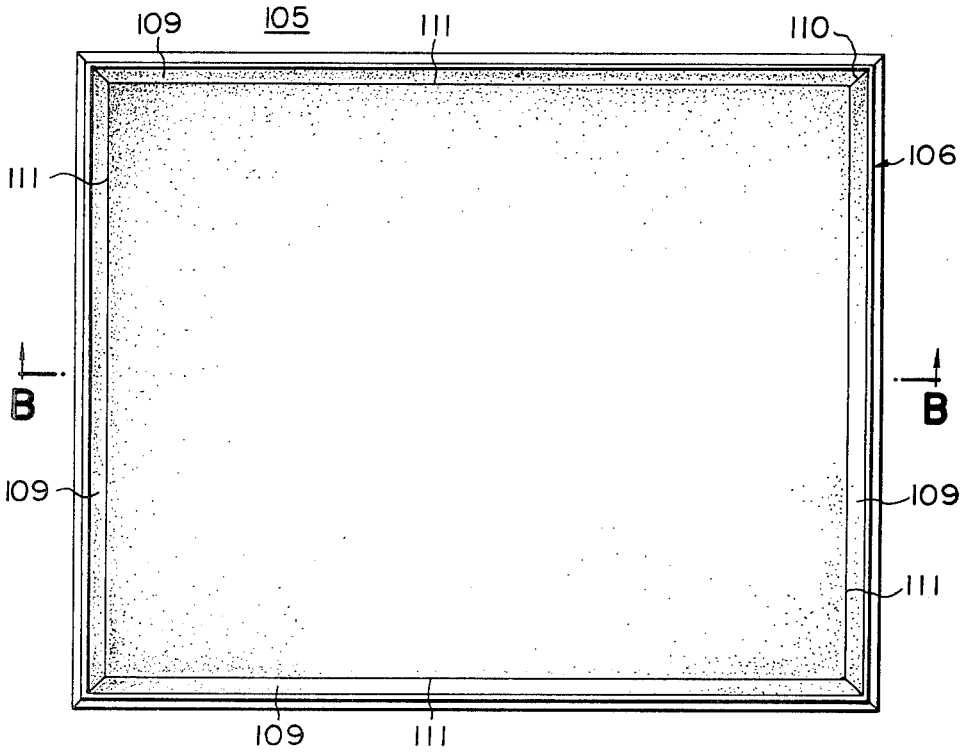

FIG. 6 shows the mat, which has, after several cleanings, shrunk as much as it will shrink, placed on the mat base plate 5. In this state, the outer edge of the mat 12 takes the almost same position as the horizontal lines 11 forming the periphery of the floor of the basin 5*a*, so that the horizontal lines 11 remain hidden from view. As can be understood by comparing FIG. 5 with FIG. 1, even when the mat 12 is shrunken and its outer perimeter comes near to the center of the basin 5*a* along said slope 9, one can see only the slope 9 between the rim 6 and the mat perimeter and there are no such crevice-emphasizing lines 4 as shown in FIG. 1, whereby it does not seem to the casual observer that the mat is shrunken.

Now, the second embodiment of this invention will be discussed hereinafter by reference to FIG. 7 to FIG. 12.

Figure 8:
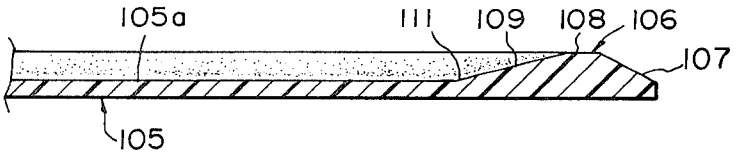
Figure 9:
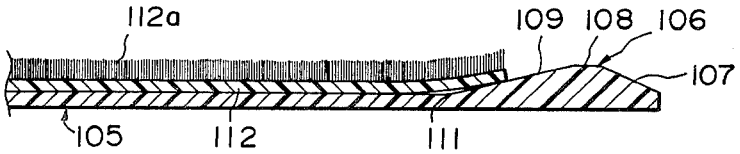
Figure 10:
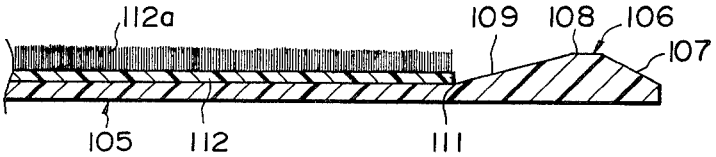
Figure 11:
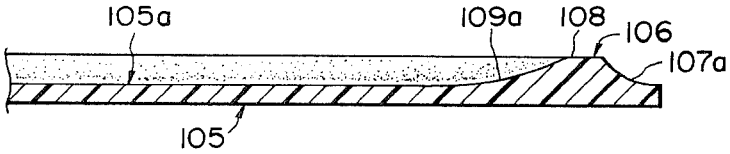
Figure 12:
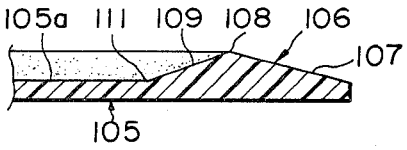
Figure 13:
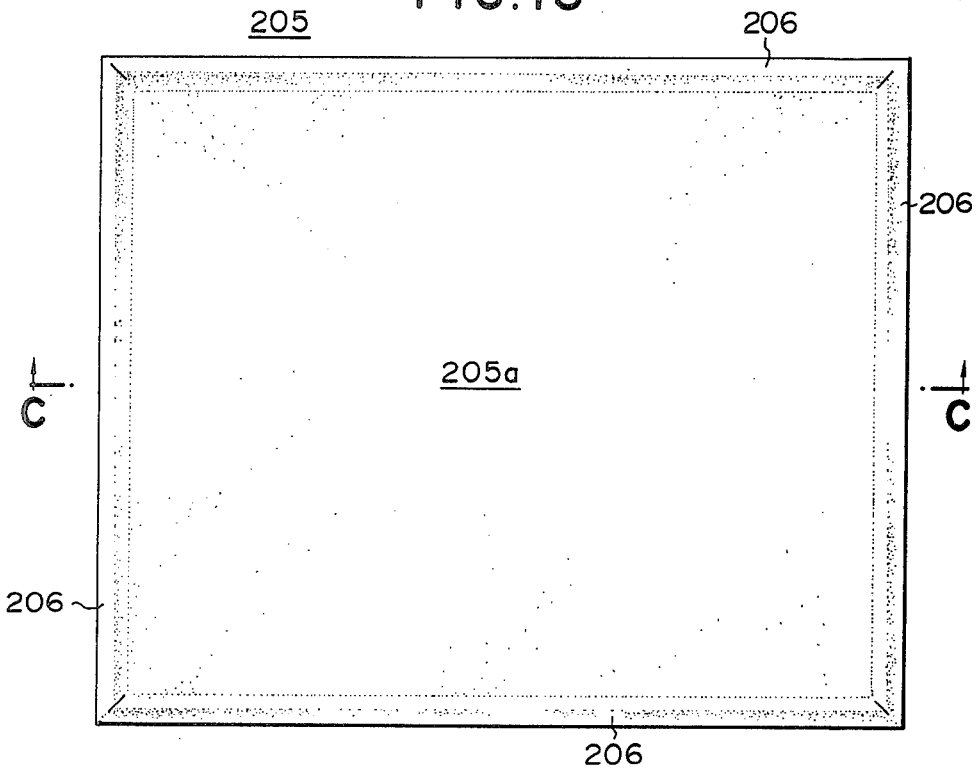

The mat base plate 105 is formed so as to have a flat rectangular plate or floor with an upstanding rim 106 around its periphery. The rim 106 has a flat top surface or plateau 108, a slope 107 which extends downward and outwardly from the plateau 108 and also another slope 109 which extends continuously from the plateau 108 down to the floor of the basin 105*a*, as shown in FIGS. 8–10. Similar to the first embodiment, there are lines 111 at the junctions of said slope 109 and the floor of the basin 105A. Similar to the first embodiment, there is no risk that a person will trip over the edge of the mat or that the mat will be torn off from the mat base plate. An aesthetic appearance can be given to the mat and also the mat base plate owing to the same reason as in the first embodiment.

Figure 14:
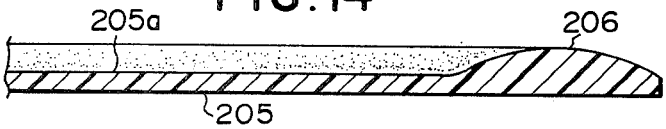
Figure 15:
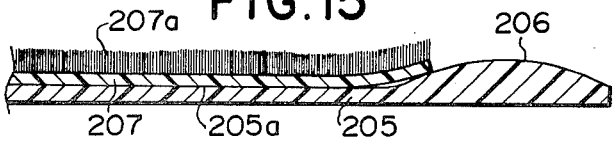
Figure 16:
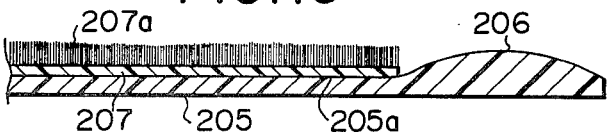
Figure 17:
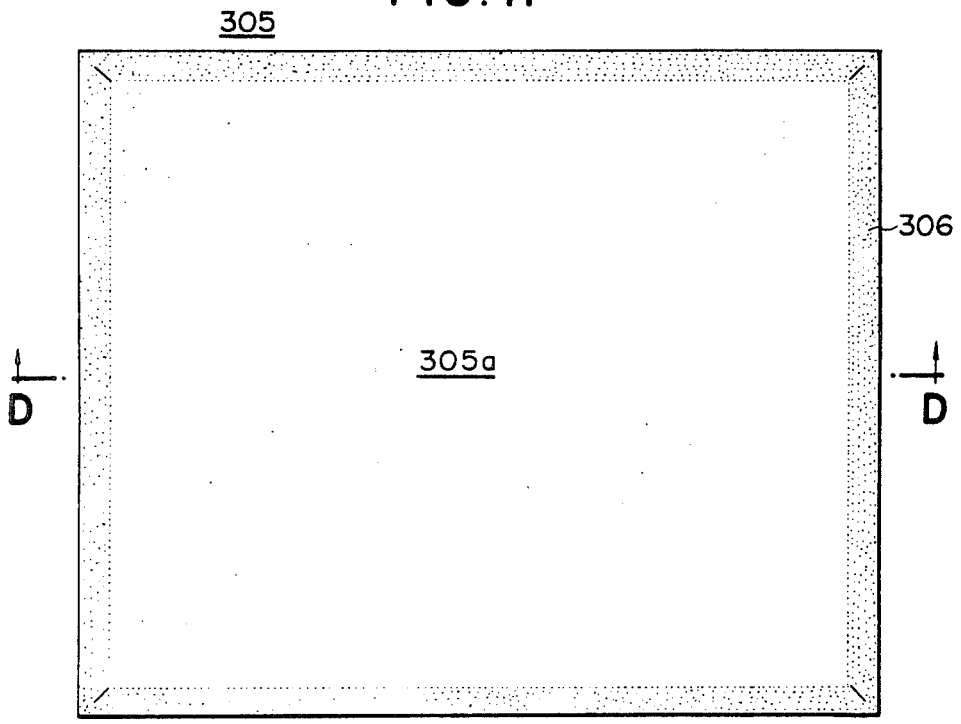
Figure 18:
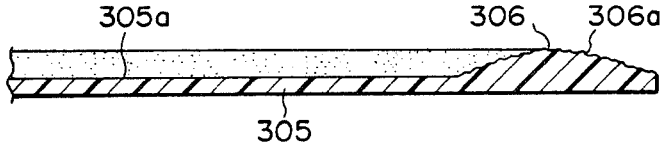
Figure 19:
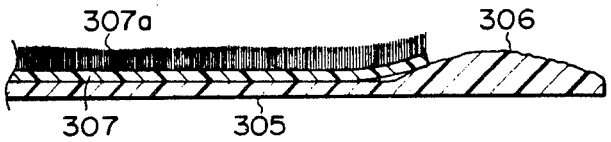
Figure 20:
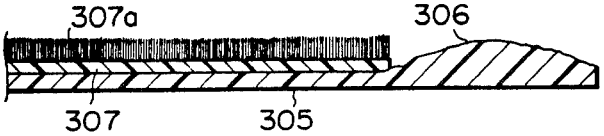

FIGS. 13–16 show the third embodiment of this invention, in which the rim 206 is semi-cylindrical or at least convexly arcuate in cross-section as particularly shown in FIG. 14. When the viewer looks at the mat base plate on which the shrunken mat is placed (FIG. 16), there are no crevices between the rim 206 and the mat 207 and consequently only an aesthetic appearance is presented.

Now, the fourth embodiment of this invention will be discussed hereinafter by reference to FIGS. 17–20, in which the semi-cylindrical or convexly arcuate rim and slope 306 has a rough surface, wave-like surface which, in cross-section, appears to be made up of a plurality of convexes and concaves. Such a wave-like surface can provide another aesthetic appearance for the mat base plate. There are provided by this embodiment similar effects to those already described in regard to the first to the third embodiments namely there are no valley lines nor crevices between the base plate rim and the outer edge of the mat and consequently an aesthetic appearance is provided.

A shown above, even when the mat is remarkably shrunken after several cleanings, the mat base plate may provide an aesthetic appearance and permits safe use without prospect for kicking off the mat from the base plate even when the mat periphery is pealed off or torn off from the mat base plate.

We claim:

1. For use in conjunction with a generally rectangular rug-like door mat made of a material which upon being repeatedly washed undergoes shrinkage in perimeter so as to become shorter and narrower than it had originally been, a door mat base plate of non-shrinkable material made of rubber or resin, comprising:

a generally flat plate portion having an upwardly-presented floor; and a rim perimetrically surrounding said flat plate portion, said rim having an apical plateau lying above said floor;

said rim further including an inner slope portion extending downwardly and inwardly from said apical plateau to said floor and an outer slope portion extending downwardly and outwardly from said apical plateau;

the inner slope portion, the apical plateau and the outer slope portion collectively providing a generally cylindrically curved rough profile in vertical transverse cross-section;

said profile being constituted by a rough surface having the appearance of a plurality of wave-like convexes and concaves;

said inner slope portion but not said apical plateau extending further inwards than the original length and width of the rug-like door mat, so that when the door mat is originally placed on said mat base plate, the door mat will be framed by said apical plateau and, depending on its size, by an outer part of said inner slope portion, and said inner slope portion extending sufficiently inwards that as the door mat shrinks in length and width as the door mat is repeatedly washed, the door mat becomes framed by and increasing proportion of the inner slope portion but the inner extent of the inner slope portion remains hidden by the mat.

2. In combination:

a generally rectangular rug-like door mat made of a material which upon being repeatedly washed undergoes shrinkage in perimeter so as to become shorter and narrower than it had originally been; and a door mat base plate of non-shrinkable material made of rubber or resin, comprising:

a generally flat plate portion having an upwardly-presented floor; and a rim perimetrically surrounding said flat plate portion, said rim having an apical plateau lying above said floor;

said rim further including an inner slope portion extending downwardly and inwardly from said apical plateau to said floor and an outer slope portion extending downwardly and outwardly from said apical plateau;

the inner slope portion, the apical plateau and the outer slope portion collectively providing a generally cylindrically curved rough profile in vertical transverse cross-section;

said profile being constituted by a rough surface having the appearance of a plurality of wave-like convexes and concaves;

said inner slope portion but not said apical plateau extending further inwards than the original length and width of the rug-like door mat, so that when the door mat is originally placed on said mat base plate, the door mat will be framed by said apical plateau and, depending on its size, by an outer part of said inner slope portion, and said inner slope portion extending sufficiently inwards that as the door mat shrinks in length and width as the door mat is repeatedly washed, the door mat becomes framed by an increasing proportion of the inner slope portion but the inner extent of the inner slope portion remains hidden by the mat.

* * * * *